US005482507A

United States Patent [19]

Priest

[11] Patent Number: 5,482,507

[45] Date of Patent: Jan. 9, 1996

[54] CLOTHES DRYER VENT

[76] Inventor: Johnny B. Priest, 86 Deerwood La., Pinehurst, N.C. 28374

[21] Appl. No.: 283,357

[22] Filed: Aug. 1, 1994

[51] Int. Cl.[6] ..... F24F 13/16

[52] U.S. Cl. ..... 454/359; 34/235

[58] Field of Search ..... 454/351, 353, 454/359, 360, 363, 271, 273; 34/235

[56] References Cited

U.S. PATENT DOCUMENTS

| | | | |
|---|---|---|---|
| 4,214,380 | 7/1980 | Meyer | 34/235 |
| 4,249,460 | 2/1981 | McSwain | 454/273 |
| 4,334,461 | 6/1982 | Ferguson et al. | 34/235 X |

*Primary Examiner*—Harold Joyce
*Attorney, Agent, or Firm*—John G. Mills & Associates

[57] ABSTRACT

A vent structure that acts as a combination masonry guide and lintel. The flat interior portion has flanged sides and a bottom disposed perpendicular to the interior plate. An opening is provided in the interior plate so a vent pipe can pass therethrough. The upper flange is the same size as a masonry lintel and is longer than and overhangs the side flanges. The structure is preferably integrally formed from plastic or metal. An exterior protective closure is mounted on the masonry guide once the building structure has been completed. The closure mounts on the vent pipe and will open when air or other fluids are passing from the vent pipe and will automatically close when the flow ceases.

7 Claims, 2 Drawing Sheets

CLOTHES DRYER VENT

FIELD OF INVENTION

This invention relates to building structures and more particularly to the venting of clothes dryers.

BACKGROUND OF INVENTION

Although various types of foundation ventilators and the like have been patented over the years, these have not received wide spread acceptance and even today standard opening 8 inches by 16 inches are left which corresponds to the size of standard building blocks. Once all masonry has been completed, vent frames and associated closures and screens are installed in the standard sized openings.

Openings for clothes dryer vents are not generally provided. This requires knocking a hole in the masonry to receive the metal sleeve for the vent. In buildings constructed from various types of sidings, (not including those veneered with brick, stone or stucco) the vent is usually placed in the floor joist band. This process is accomplished with a large electric drill and a hole saw. Both of the usual methods of installing dryer vents are labor intensive and time consuming.

In the construction of masonry as well as brick, stone and stucco veneer structures, a lintel is placed across the top of each of the normal 8 inch by 16 inch openings that are left so that foundation vents can be installed after all of the masonry work has been completed. These lintels support the rows of building material that is constructed above the opening. Since the use of lintels in openings is well known to those skilled in the art, further detailed discussion of the same is not deemed necessary.

Concise Explanation of References

The Vent Instruction publication discloses the present day method of installing new or replacement ventilators in ventilator openings.

U.S. Pat. No. 4,026,082 to Crofoot discloses a vent frame covering the entire opening and being embedded in a concrete foundation. The modification shown in FIG. 9 is an installation similar to the publication reference.

U.S. Pat. No. 3,220,079 to Aggson is also a foundation vent that is installed in a poured foundation.

U.S. Pat. No. 2,882,961 to Sola discloses a foundation vent with a special opening to receive the discharge nozzle of an insecticide dispenser.

U.S. Pat. No. 2,348,148 to Rankin discloses a ventilator that prevents light from passing therethrough and is particularly adapted for air raid shelters.

U.S. Pat. Nos. 1,816,769 and 1,896,053 both to E. T. Fisk are considered of interest in that they disclose sound suppressing ventilators.

U.S. Pat. No. 2,557,566 to Ronfeldt is considered of interest in that it discloses a foundation ventilator that, when closed, resembles the adjacent brick foundation.

U.S. Pat. No. 2,738,838 to Sutter is considered of general interest in that it discloses a glass block ventilating device while U.S. Pat. No. 848,917 to McElligott et al is of general interest in that it discloses an outside opening for a vertical air circulation passage.

BRIEF DESCRIPTION OF INVENTION

After much research and study into the above mentioned problems, the present invention has been developed to provide a frame for a one half standard building block size opening, i.e. an opening 8 inches by 8 inches.

No separate lintel is required to support the building material above the opening since a built-in lintel is incorporated into the present invention.

By providing a base frame with closure louvers that can be added when the clothes dryer vent pipe is connected to the present invention, damage is prevented to the parts of the vent during construction by excess mortar and occasional falling bricks.

The above is accomplished by providing a mortar frame with an elongated extended flange on the top thereof forming a lintel that is placed in the foundation during construction. When the building structure is completed, the dryer vent pipe is secured to the interior of the frame and a louvered closure attached by screws or other means to the exterior thereof. This prevents unwanted cold or hot ambient air, vermin or the like from entering the pipe when the dryer is not operating and yet will allow the air from the clothes dryer to exhaust by pivoting the louvered closures from vertical to a generally horizontal position.

In view of the above it is an object of the present invention to provide a clothes dryer vent box that can be installed when the foundation vents of a building structure are being placed in a masonry foundation or when a brick, stone and stucco veneer structure is being built.

Another object of the present invention is to provide an opening for clothes dryer vent pipes that does not require a separate lintel.

Another object of the present invention is to provide a means for sizing a one half block opening in a foundation wherein clothes dryer vents and louver dampers can be added following the completion of the building.

Another object of the present invention is to provide a means for installing a clothes dryer vent in the foundation of a building structure requiring only a screw driver and four self tapping screws to accomplish the same.

Another object of the present invention is to provide a half block foundation opening formed with a cap and that also serves as a lintel for the opening.

Other objects and advantages of the present invention will become apparent and obvious from a study of the following description and the accompanying drawings which are merely illustrative of such invention.

DETAIL DESCRIPTION OF INVENTION

With further reference to the drawings, the clothes dryer vent of the present invention, indicated generally at 10, includes a masonry guide portion indicated generally at 11 and a louvered portion, indicated generally at 12.

The masonry guide portion includes an interior flat plate 13 with a relatively large central opening 14 therein. A plurality of guide holes 15 are also provided in plate 13.

Generally flat side flanges 16 and 17 are connected to, and preferably integrally formed with, plate 13 and are disposed perpendicular thereto.

Figure 1:
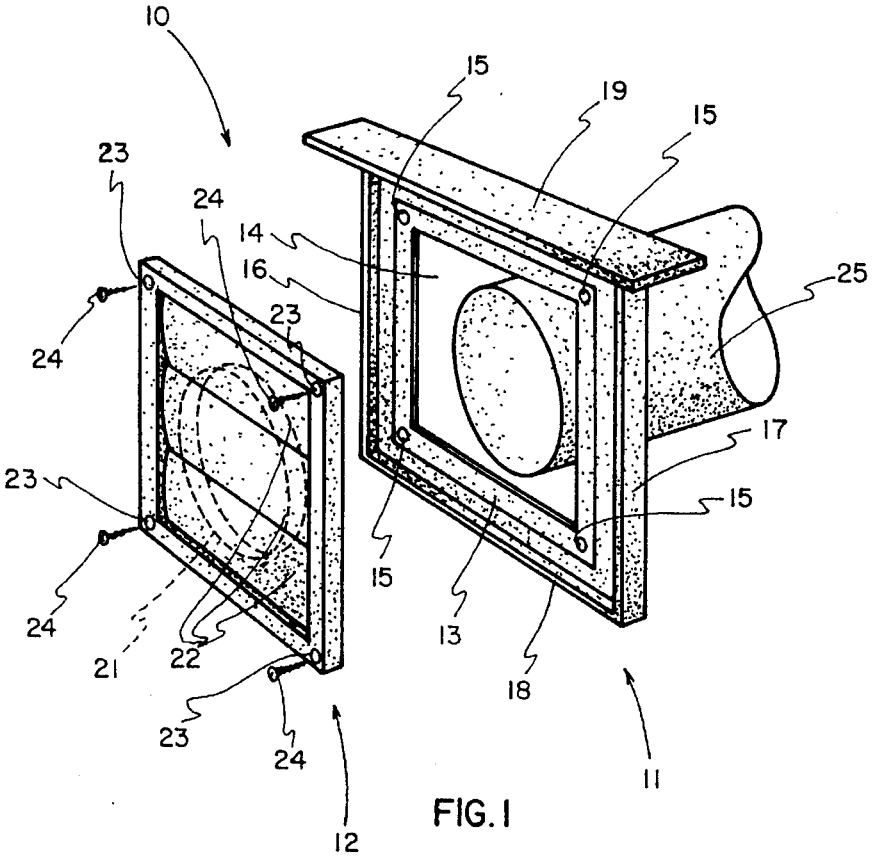
FIG. 1 is an exploded view of the clothes dryer vent of the present invention.

A bottom flange 18 extends between the lower edges of side flanges 16 and 17 and is secured to plate 13, and preferably integrally formed therewith, and perpendicularly disposed thereto as can clearly be seen in FIG. 1.

Finally, an enlarged lintel flange 19 is generally flat in configuration, is approximately as wide as a standard lintel, used in foundation vent lintels and extends outwardly past side flanges 16 and 17. This lintel flange is disposed perpendicularly to plate 13, is connected thereto, and is preferably integrally formed therewith.

The overall dimensions between the outer surfaces of side flanges 16 and 17 is preferably 8 inches or one half of the length of a standard building block. The distance between the outer edges of bottom flange 18 and the top of lintel flange 19 is preferably eight inches or approximately the height of a standard building block.

The closure portion 12 shown in the drawings is a commercially available item. It includes an integrally molded outer frame 20, a vent pipe receiving ring 21 and freely suspended louvers 22. Also opening 23 are formed at the corners of frame 20 and are adapted to slidingly receive rust and corrosion resistance screws 24 as can clearly be seen in the exploded view of FIG. 1. These screws 24 are preferably of the self-tapping type.

Vent pipe 25 is mounted in receiving ring 21 of closure portion 12 and is connected at its opposite end to a standard clothes dryer (not shown) or other means that needs venting.

When the clothes dryer vent of the present invention is being installed, the lower courses of brick 26 are laid to the desired height of the bottom of the vent. The side courses of brick 27 are laid to the desired location on the lower courses of brick.

The masonry guide portion 11 of the present invention is then placed on the lower courses of the brick with mortar therebetween adjacent the side courses of brick 27 with mortar therebetween with one end of the lintel flange 19 resting on top of said side course of bricks. A second side course of bricks 28 are laid adjacent side flange 17 with mortar therebetween. The upper courses of brick 29 are then laid above the side course of brick 27 and 28 and across lintel flange 19.

Once the mortar hardens, the masonry guide portion 11 of the present invention is a permanent fixture in the wall.

The present invention can be installed both in masonry foundations as well as in brick, stone, and stucco veneer structures basically following the installation methods described above. Since masonry work of this type is well known to those skilled in the art, further detailed discussion of the same is not deemed necessary.

Once the building structure, indicated generally at 30, has been completed, any loose dirt, water or the like that would interfere with mounting the closure portion 12 of the present invention on the masonry guide portion 11 is removed. The closure portion is then placed juxtaposed to the flat plate 13 of portion 11 with the plate openings 14 being in alignment with the screw openings 23 in closure frame 20. The self tapping screws 24 are passed into openings 15. The vent pipe 25 is then inserted into the receiving ring 21 of closure portion 12 and the dryer vent installation is complete.

Figure 2:
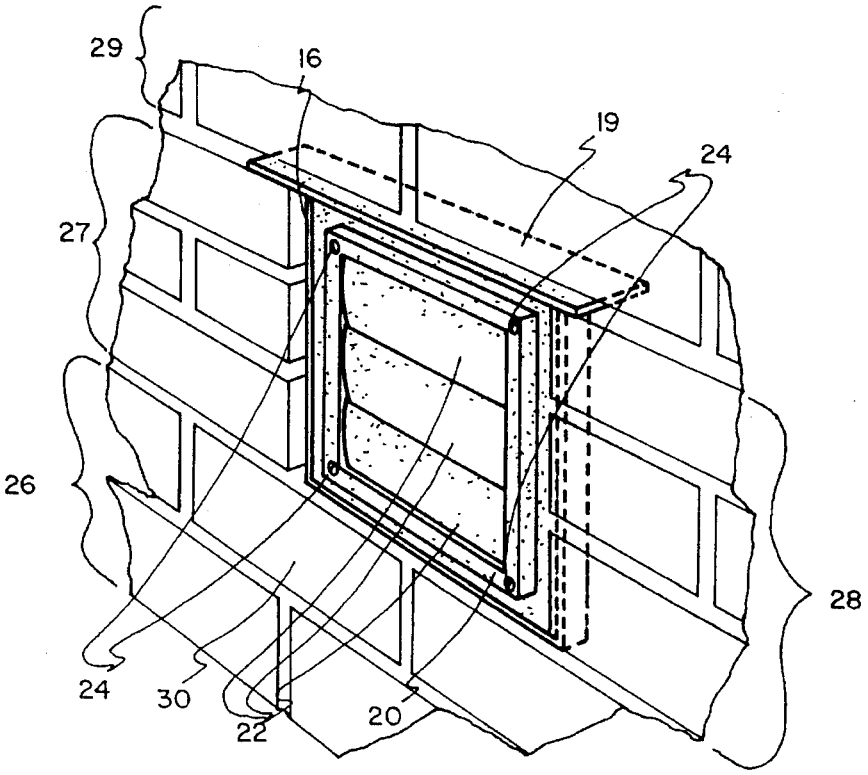
FIG. 2 is a perspective view of the present invention in place in the foundation of a building structure.
Figure 3:
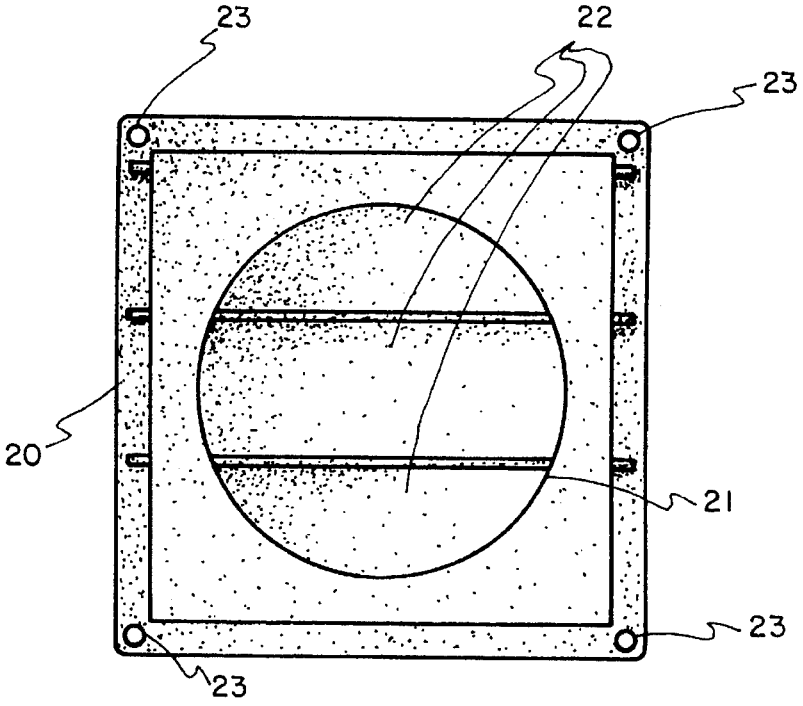
FIG. 3 is a rear perspective view of the louvered damper vent cover.
Figure 4:
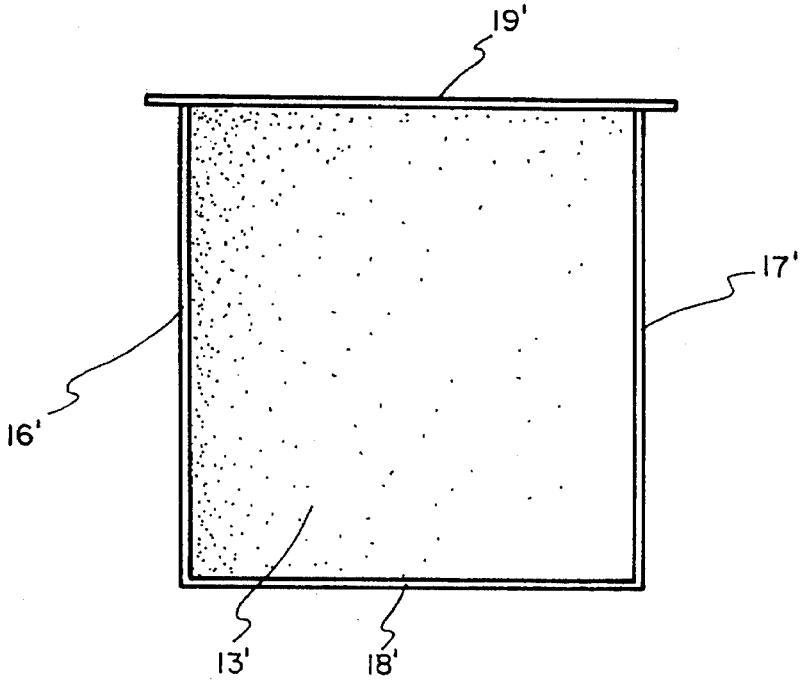
FIG. 4 is an elevational view of a modification thereof.

Whenever air or other fluids are passing out of vent pipe 25, the gravity closed louvers 22 will be forced from the generally vertical closed position shown in FIG. 2 to a generally horizontal position to allow the fluids to pass therethrough. Once fluids cease from vent pipe 25, the louvers 22 will automatically close, again as shown in FIG. 2, to prevent vermin, hot and cold ambient air and the like from entering said vent pipe.

The interior flat plate 13 of the present invention can, of course, be solid. This would allow telephone and television cable lines and the like to be passed therethrough by simply drilling a hole of appropriate size in said plate. Also an electric meter box could be mounted on said plate thus eliminating the normal heavy drilling necessary to make such installations.

From the above it can be seen that the present invention provides a relatively simple and yet highly efficient vent that can be used in foundations as well as in brick, stone and stucco veneers. It allows the installing mason (not shown) to properly align and size the vent opening and also acts as a lintel for the courses of building material placed thereabove. The present invention is inexpensive, is easy to use and is impervious to natural elements.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A clothes dryer vent structure for installation in building foundations, and in brick, stone, and stucco, veneer structures comprising: a masonry guide portion including a generally flat area having a central opening therein through which a vent pipe can be passed and having two side edges, a bottom edge and a lintel-like upper edge for installation in said foundation and in brick, stone and stucco veneer structures; and a closure portion including an integrally formed receiving ring for fixedly attaching said vent pipe, said closure portion being mounted on the generally flat area of said masonry guide portion whereby said guide portion can be installed in foundation and in brick, stone and stucco veneer structures when the same is being built and said closure portion can be attached to said guide portion thereafter.

2. The clothes dryer vent structure of claim 1 wherein the generally flat area, the two side edges, the bottom edge and the lintel-like upper edge of the masonry guide portion are integrally formed.

3. The clothes dryer vent structure of claim 2 wherein said masonry guide portion is formed from a plastic material.

4. The clothes dryer vent structure of claim 2 wherein said masonry guide portion is formed from metal.

5. The clothes dryer vent structure of claim 1 wherein the closure portion is mounted on the guide portion by screw-type securing means.

6. The clothes dryer vent structure of claim 5 wherein said screw-type securing means are self-tapping.

7. The clothes dryer vent structure of claim 1 wherein the overall width of the guide portion is one half of length of the standard building blocks and the height thereof is the same height of standard building blocks.

* * * * *